US011187411B2

(12) United States Patent
Ebel et al.

(10) Patent No.: US 11,187,411 B2
(45) Date of Patent: Nov. 30, 2021

(54) COMBUSTION CHAMBER ASSEMBLY WITH SHINGLE PART AND POSITIONING FACILITY

(71) Applicant: Rolls-Royce Deutschland Ltd & Co KG, Blankenfelde-Mahlow (DE)

(72) Inventors: Michael Ebel, Rangsdorf (DE); Kay Heinze, Ludwigsfelde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 64 days.

(21) Appl. No.: 16/539,458

(22) Filed: Aug. 13, 2019

(65) Prior Publication Data

US 2020/0056787 A1 Feb. 20, 2020

(30) Foreign Application Priority Data

Aug. 17, 2018 (DE) ..... 10 2018 213 925.3

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00017* (2013.01)

(58) Field of Classification Search
CPC .... F23R 3/002; F23R 3/60; F23R 3/04; F23R 2900/00017
See application file for complete search history.

(56) References Cited

U.S. PATENT DOCUMENTS

| | | | | |
|---|---|---|---|---|
| 5,396,763 | A * | 3/1995 | Mayer | F23R 3/20 60/749 |
| 5,609,031 | A | 3/1997 | Jones | |
| 10,190,773 | B2 | 1/2019 | Hanson et al. | |
| 2009/0205314 | A1* | 8/2009 | Schmahl | F23R 3/60 60/266 |
| 2011/0000216 | A1* | 1/2011 | Imamura | F23R 3/60 60/748 |
| 2011/0318531 | A1 | 12/2011 | Krusch | |
| 2013/0031908 | A1* | 2/2013 | DiCintio | F23R 3/346 60/752 |

(Continued)

FOREIGN PATENT DOCUMENTS

| | | | |
|---|---|---|---|
| DE | 69530557 | T2 | 4/2004 |
| DE | 102014222320 | A1 | 5/2016 |

(Continued)

OTHER PUBLICATIONS

EBEL—U.S. Appl. No. 16/793,773, filed Feb. 18, 2020.

(Continued)

*Primary Examiner* — Katheryn A Malatek
(74) *Attorney, Agent, or Firm* — Shuttleworth & Ingersoll, PLC; Timothy Klima

(57) ABSTRACT

A combustion chamber assembly for an engine with at least one tile component, on the cold side of which facing away from a combustion space, a positioning aid with at least two positioning elements, wherein a defined position relative to the combustion chamber component is predefined for the tile component via the contact of the at least two positioning elements on at least one contact face of the combustion chamber component in two spatial axes.

16 Claims, 7 Drawing Sheets

(56) References Cited

U.S. PATENT DOCUMENTS

| | | | | |
|---|---|---|---|---|
| 2013/0318979 | A1 | 12/2013 | Kramer et al. | |
| 2014/0144148 | A1* | 5/2014 | Jause | F02C 7/28 60/772 |
| 2015/0260400 | A1 | 9/2015 | Clemen | |
| 2016/0186999 | A1 | 6/2016 | Freeman et al. | |
| 2018/0252413 | A1 | 9/2018 | Clemen et al. | |

FOREIGN PATENT DOCUMENTS

| | | | |
|---|---|---|---|
| DE | 102017203326 | A1 | 9/2018 |
| DE | 102018213925 | A1 | 2/2020 |
| EP | 2728255 | A1 | 5/2014 |
| EP | 2918915 | A1 | 9/2015 |
| EP | 3369996 | A1 | 9/2018 |
| EP | 3255344 | B1 | 2/2019 |
| WO | 2010105709 | A2 | 9/2010 |

OTHER PUBLICATIONS

German Search Report dated May 9, 2019 from counterpart German Patent Application No. DE102018213925.3.
German Search Report dated Nov. 6, 2019 for related German Patent Application No. 10 2019 202 466.1.

* cited by examiner

State of the Art

COMBUSTION CHAMBER ASSEMBLY WITH SHINGLE PART AND POSITIONING FACILITY

This application claims priority to German Patent Application DE102018213925.3 filed Aug. 17, 2018, the entirety of which is incorporated by reference herein.

The proposed solution relates to a combustion chamber assembly for an engine.

A generic combustion chamber assembly comprises amongst others a combustion chamber component as part of a combustion chamber structure surrounding a combustion space, and a tile component fixed to the combustion chamber component. The tile component, which for example may be a combustion chamber tile or a heat shield, has a hot side facing the combustion space and a cold side facing away from the combustion space and towards the combustion chamber component. Via the tile component, the combustion chamber structure—and hence e.g. a combustion chamber housing formed thereby—is protected from the high temperatures which occur during combustion in the combustion space. Normally, a tile component has at least one passage opening, for example in the form of a mixing air hole, and on the cold side at least one fixing element, for example in the form of a (screw or threaded) bolt for fixing the tile component to the combustion chamber component. The combustion chamber component has at least one fixing opening for the at least one fixing element, and at least one supply opening for the passage opening. When the combustion chamber assembly is in mounted state, the passage opening on the tile component is brought into alignment with the at least one supply opening, for example in the form of a mixing air hole in the combustion chamber structure, so that air can pass through the supply opening into the combustion chamber component and through the passage opening in the tile component into the combustion space.

In order to achieve optimal conditions here with regard to cooling and emission performance, reliable positioning is necessary of the tile component relative to the combustion chamber component and in particular the supply opening present here. It must furthermore be guaranteed that the mechanical integrity of the fixing elements of the tile component is not endangered by the positioning of the tile component relative to the combustion chamber component during installation of the tile component and during operation of the engine.

In practice, the positioning of a tile component of a combustion chamber assembly, in particular a combustion chamber tile, is often subject to relatively great spread which must be taken into account in the design and the tolerances to be expected. If for example combustion chamber tiles are not positioned precisely relative to the mixing air holes provided in the combustion chamber wall (as supply openings), the supplied mixing air is subject to undesirable variation. The combustion chamber tiles distributed over the combustion chamber wall, and their passage openings, may then under certain circumstances be positioned differently relative to the mixing air holes in the combustion chamber wall. This leads to variations in the supply of mixing air to the combustion chamber and can lead to irregularities in the temperature distribution of the process gas, whereby again the consumption of cooling air and in some cases the service life of the components of the combustion chamber assembly may be adversely affected. Also, an uneven distribution of the mixing air supplied via the mixing holes inside the combustion space may lead to an uneven air-fuel distribution and hence to sub-optimal emission values.

In order to ensure as precise as possible a positioning of a tile component relative to a combustion chamber component, frequently manual mounting is provided in which individual tile components are carefully oriented relative to the assigned combustion chamber component and also to each other by an engineer. The production of a corresponding combustion chamber assembly is therefore highly individualised and also extremely time-consuming.

The proposed solution is therefore based on the object of providing a combustion chamber assembly which is improved in this respect, and in particular also an improved production method for such a combustion chamber assembly with at least one tile component.

This object is achieved both with a combustion chamber assembly and also with a production method according to the present disclosure.

In a proposed combustion chamber assembly, on the cold side of the tile component, a positioning aid is provided with at least two positioning elements. Thus the tile component has a predefined position relative to the combustion chamber component via the contact of the at least two positioning elements on at least one contact face of the combustion chamber component in at least two spatial axes. Thus elements of a positioning aid are integrated at least on the tile component in order to predefine as precisely as possible a specific relative position of the tile component when mounting on the combustion chamber component, and hence independently of any tolerances for the openings to be brought into mutual alignment on the tile component and the combustion chamber component, and independently of fixing elements of the tile component and fixing openings provided for this on the combustion chamber component. A tile component to be installed may therefore be always given a specific position on the combustion chamber component via the positioning aid, so that for a tile component to be installed, a reproducible and precise positioning which is largely independent of tolerances can be achieved in a simple and rapid fashion.

If on installation, the tile component bears against the contact faces provided for this of the combustion chamber component in the two spatial axes via the positioning elements of the positioning aid, the tile component is positioned precisely and may therefore be fixed in the defined position relative to the combustion chamber component without further orientation.

The proposed solution is here in particular independent of whether the tile component is a heat shield which is fixed to a head plate as a combustion chamber component, or a combustion chamber tile which is fixed to a combustion chamber wall (radially on the inside or radially on the outside relative to the central axis of the engine).

In one embodiment variant, the two spatial axes along which a specific relative position is predefined via the positioning aid with the at least two positioning elements of the tile component, run perpendicularly to each other. In particular, these spatial axes may each run perpendicularly to an attachment direction in which the tile component is or can be mounted on the combustion chamber component before the tile component is fixed via the at least one fixing element passing through the associated fixing opening.

If for example a combustion chamber tile, as an embodiment variant of a tile component of the combustion chamber assembly, is mounted on a combustion chamber wall in the radial direction relative to a longitudinal axis of the combustion space, a first spatial axis of the two spatial axes runs in a circumferential direction along which several tile components are arranged next to each other about the longitudinal axis. A second spatial axis of the two spatial axes then extends in a flow direction in which fluid flows in the direction of an outlet from the combustion space in operation of the engine. In the case of a tile component configured as a heat shield, the two spatial axes run for example firstly in the circumferential direction and secondly in the radial direction.

A tile component can easily be moved, in particular pushed, along the two spatial axes in a respective one of two possible and mutually opposed directions via the at least two positioning elements of the positioning aid integrated on the tile component, until the positioning elements bear against the associated contact face of the combustion chamber component when the tile component has been brought to the combustion chamber component in the attachment direction. The tile component is then fixed to the combustion chamber component in the relative position thus assumed.

In an embodiment variant, several fixing elements are provided on the cold side of the tile component which engage in respective fixing openings of the combustion chamber component, e.g. with circular cross-sectional area, for fixing the tile component to the combustion chamber component. The individual fixing elements are for example (screw or threaded) bolts which must pass through assigned fixing openings on a combustion chamber component in order to be fixed to the combustion chamber component, for example via nuts additionally provided. Because of the tolerances which must be provided, and because of any play to take account of any displacement of the fixing elements occurring in operation due to thermally induced expansion of the tile component, a tile component attached to the combustion chamber component is still able to be aligned before fixing in such a configuration with several fixing elements, and hence need not necessarily be established in the precise position on the combustion chamber component before fixing. Then however a clear relative position can be predefined by the additionally provided positioning elements. A cross-sectional area of a fixing opening may e.g. be circular but also oval, polygonal or slot-like.

In one embodiment variant, at least one of the positioning elements of the positioning aid is provided at an edge protruding in the direction of the combustion chamber component and edging a passage opening in the tile component. At least one of the positioning elements is thus deliberately provided additionally in the region of a passage opening, present in any case in the tile component, in order to facilitate precise positioning of the tile component on the combustion chamber component. The positioning aid is thus integrated on the tile component in a material-saving manner.

For example, the at least one positioning element provided on the edge is formed only protruding locally at the edge. Thus a protruding widening, in particular a thickening, is provided only locally at the protruding end of the passage opening, for dedicated contact on a contact face of the combustion chamber component. The contact face of the combustion chamber component may be formed for example on an inner casing surface of the supply opening. For example, the positioning element protrudes locally as a lug or web and stands radially relative to a central point of a passage opening of circular cross-section in the tile component.

In an exemplary embodiment, two positioning elements are provided on an edge of a passage opening of the tile component which protrudes in the direction of the combustion chamber component. In this variant therefore, at the edge of a passage opening of the tile component, defined contact points or contact faces may be provided via two positioning elements along two different spatial axes which may be perpendicular to each other, for precise positioning of the tile component relative to the combustion chamber component. Here, a first positioning element of the two positioning elements provided at the edge may be formed locally protruding along a first spatial axis of the two spatial axes, and a second positioning element of the two positioning elements positioned at the edge may be formed locally protruding along a second spatial axis of the two spatial axes.

Alternatively or additionally, the tile component may have at least two passage openings, for example each in the form of mixing air holes in the tile, wherein at least one positioning element of the positioning aid is provided at an edge of each of these passage openings protruding in the direction of the combustion chamber component. Also, several fixing elements may be provided on the cold side of the tile component, which engage in fixing openings of the combustion chamber component for fixing the tile component to the combustion chamber component, and of which at least one fixing element is provided in a central region of the tile component. The tile component may therefore comprise fixing elements closer to the edge and at least one fixing element provided centrally in the broadest sense. The tile component expands because of the high temperatures prevailing in operation of the engine. Then however a central fixing element is regularly established, precisely positioned at a fixing opening of the combustion chamber component, and the other fixing elements provide compensation for the thermally induced expansion. Thus the fixing openings for the fixing elements of the tile component closer to the edge guarantee a thermally induced displaceability of the fixing elements within the associated fixing openings and hence relative to the at least one central fixing element. The central fixing element, which need not necessarily be provided in the middle, thus remains in position during operation of the engine, whereas the engagement with play of the other fixing elements, provided closer to the edge of the tile component, in their respective fixing openings on the combustion chamber component compensates for a thermally induced expansion of the tile component. A displacement of the fixing elements closer to the edge inside the associated fixing openings due to thermally induced expansion of the tile component is thus deliberately permitted.

With regard to the design of the positioning aid on the tile component, in this configuration it may be suitable that a positioning element provided at a protruding edge of the passage opening faces the fixing element provided in the central region of the tile component. The arrangement of a positioning element on a face which faces the fixing element provided in a central region of the tile component—and does not therefore face away—prevents the positioning element from being pressed against its contact face on the combustion chamber component due to the thermally induced expansion of the tile component (namely in an extension direction of the tile component away from the fixing element provided in the central region of the tile component). The proposed arrangement avoids a thermally induced expansion of the tile component pressing the positioning element more strongly against its contact face, which could damage it.

At least two passage openings may be provided on the tile component which have different distances from the fixing element provided in the central region of the tile component. If two positioning elements are provided at an edge of one of these passage openings, in one embodiment variant the two positioning elements are provided at the edge protruding in the direction of the combustion chamber component, the passage opening of which has the smallest distance from the fixing element provided in the central region of the tile component. Since the fixing element provided in the central region undergoes no thermally induced displacement relative to the combustion chamber component in operation of the engine, the positioning elements at the edge of the passage opening closest to the fixing element also largely retain their position relative to the combustion chamber component which they assumed during installation under ambient conditions.

In one embodiment variant, at least one positioning recess, which has a contact face for at least one of the positioning elements, may be provided on the combustion chamber component. In this embodiment variant therefore, a contact face is not formed by a casing surface of a supply opening which is in any case present on the combustion chamber component, for example in the form of a mixing air hole. Rather, here an additional positioning recess is provided in which a positioning element engages when the tile component is correctly attached to the combustion chamber component.

A positioning recess may here for example also be formed at an edge of a supply opening of the combustion chamber component. For example, a supply opening formed as a mixing air hole of the combustion chamber component may then at its edge be formed with a radial depression or rebate as a positioning recess in which a positioning element of the tile component engages. A positioning element may bear on a contact face in one or two spatial axes inside a positioning recess.

In one embodiment variant, at least one of the positioning elements engages in a positioning opening of the combustion chamber component which is spaced from the at least one passage opening and the at least one fixing element of the tile component. The combustion chamber component thus forms a separate positioning opening provided exclusively for engagement of the positioning element. Such a configuration may evidently be simply combined with one of the above-mentioned other embodiment variants, in particular a variant in which one of the positioning elements is formed locally protruding at an edge of a passage opening of the tile component.

In one embodiment variant, two positioning openings are formed, one for each positioning element on the combustion chamber component. Here, a first positioning opening may be formed with a circular cross-section, and a second positioning opening may be formed with a slot-like cross-section. For example, then two (circular) cylindrical, pin-like or peg-like positioning elements are provided on the cold side of the tile component, wherein a first circular cylindrical positioning element is held by form fit concentrically inside the first positioning opening, and a second circular cylindrical positioning element is held by form fit inside the second positioning opening. The second circular cylindrical positioning element then however bears only against mutually opposing primary contact face portions of the second positioning opening and is spaced from secondary contact face portions which respectively connect the primary contact face portions together and lie opposite each other. Thus on mounting of the tile component, a defined relative position can also be predefined relative to the combustion chamber component via the two positioning openings and the positioning elements engaging therein. Due to the design of the second positioning opening with slot-like cross-section, firstly over-determination is avoided and secondly a thermally induced expansion of the tile component is also permitted in the region of the positioning elements.

A further aspect of the proposed solution concerns a method for producing a combustion chamber assembly for an engine. Here, firstly a combustion chamber structure surrounding a combustion space is provided, with a combustion chamber component and a tile component to be fixed to the combustion chamber component and having a hot side which faces the combustion space in correctly mounted state, and a cold side which faces away from the combustion space and towards the combustion chamber component in correctly mounted state. The tile component furthermore comprises at least one passage opening and, on the cold side, at least one fixing element for fixing the tile component to the combustion chamber component. The combustion chamber component furthermore comprises at least one fixing opening for the at least one fixing element, and at least one supply opening with which the passage opening of the tile component can be brought into alignment when the tile component is mounted on the combustion chamber component. To facilitate positioning of the tile component on the combustion chamber component before fixing of the tile component, a positioning aid with at least two positioning elements is provided on the cold side of the tile component. When mounting on the combustion chamber component, a defined position relative to the combustion chamber component can be predefined for the tile component via the contact of the at least two positioning elements on at least one contact face of the combustion chamber component in two spatial axes, before the tile component is fixed to the combustion chamber component. Consequently, for the precise attachment of the tile component to the combustion chamber component, an engineer for example manually positions the tile component correctly on the combustion chamber component, in that the positioning elements provided additionally for this and spaced apart from each other on the tile component are pressed against assigned contact faces on the combustion chamber component. Then the tile component is fixed to the combustion chamber component in the relative position predefined by the positioning elements.

In one embodiment variant, it is provided that at least one of the positioning elements is subsequently formed on the cold side of the tile component which has previously been produced with the at least one passage opening. The tile component is thus already preproduced with the at least one passage opening before the at least one positioning element is moulded thereon in a separate work process, to form the positioning aid. Also, the at least one fixing element, for example in the form of a (screw or threaded) bolt may already be formed on the preproduced tile component before the positioning element is subsequently moulded on in a separate working process.

Here, the at least one positioning element may be moulded on an edge protruding in the direction of the combustion chamber component and edging the at least one passage opening in the tile component. The positioning aid with the at least two positioning elements is thus only later moulded on the tile component which is for example cast.

Alternatively, the positioning aid may be formed on the tile component in an additive production process.

The appended figures illustrate exemplary possible design variants of the proposed solution.

Figure 4:
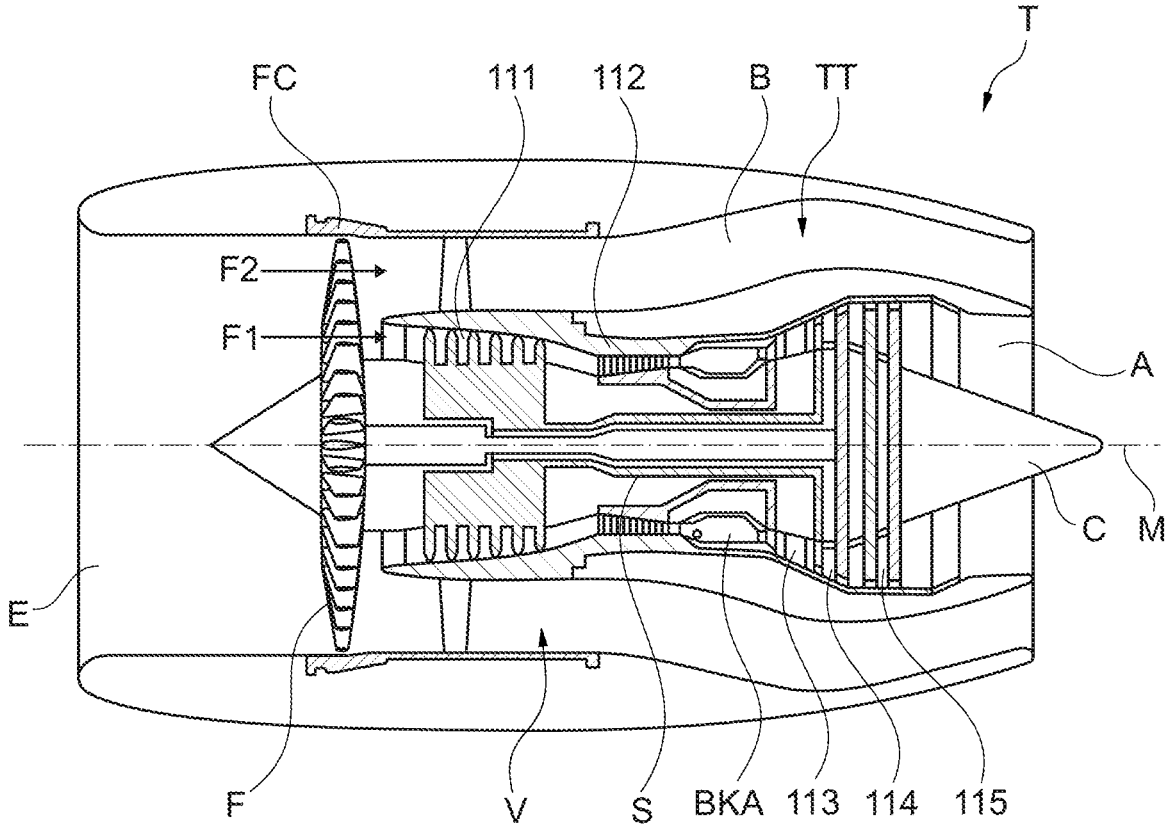
FIG. 4 shows an engine in which a combustion chamber assembly corresponding to FIGS. 1A to 10 is used.

FIG. 4 illustrates, schematically and in a sectional illustration, an engine T in which the individual engine components are arranged one behind the other along an axis of rotation or central axis M, and the engine T is formed as a turbofan engine. At an inlet or intake E of the engine T, air is drawn in along an inlet direction by means of a fan F. This fan F, which is arranged in a fan casing FC, is driven by means of a rotor shaft S which is set in rotation by a turbine TT of the engine T. Here, the turbine TT adjoins a compressor V, which comprises for example a low-pressure compressor 111 and a high-pressure compressor 112, and possibly also a medium-pressure compressor. The fan F on one side conducts air in a primary air flow F1 to the compressor V, and on the other side, to generate thrust, in a secondary air flow F2 to a secondary flow channel or bypass channel B. The bypass channel B here runs around a core engine comprising the compressor V and the turbine TT and comprising a primary flow channel for the air supplied to the core engine by the fan F.

The air conveyed into the primary flow channel by means of the compressor V passes into a combustion chamber portion BKA of the core engine, in which the drive energy for driving the turbine TT is generated. For this purpose, the turbine TT has a high-pressure turbine 113, a medium-pressure turbine 114 and a low-pressure turbine 115. Here, the energy released during the combustion is used by the turbine TT to drive the rotor shaft S and thus the fan F in order to generate the required thrust by means of the air conveyed into the bypass channel B. Both the air from the bypass channel B and the exhaust gases from the primary flow channel of the core engine flow out via an outlet A at the end of the engine T. In this arrangement, the outlet A generally has a thrust nozzle with a centrally arranged outlet cone C.

In principle, the fan F can also be coupled, via the rotor shaft S and an additional epicyclic planetary gear mechanism, to the low-pressure turbine 115 and can be driven by the latter. It is furthermore also possible to provide other gas turbine engines of different configurations in which the proposed solution can be used. For example, engines of this type may have an alternative number of compressors and/or turbines and/or an alternative number of rotor shafts. By way of example, the gas turbine engine can have a split flow nozzle, meaning that the flow through the bypass channel B has its own nozzle that is separate from and radially outside the core engine nozzle. However, this is not limiting, and any aspect of the present disclosure may also apply to engines in which the flow through the bypass channel B and the flow through the core are mixed or combined before (or upstream of) a single nozzle, which may be referred to as a mixed-flow nozzle. One or both nozzles (whether mixed flow or split flow) may have a fixed or variable region. Whilst the described example relates to a turbofan engine, the proposed solution may be applied, for example, to any type of gas turbine engine, such as an open-rotor (in which the fan stage is not surrounded by a nacelle) or turboprop engine, for example.

Figure 5:
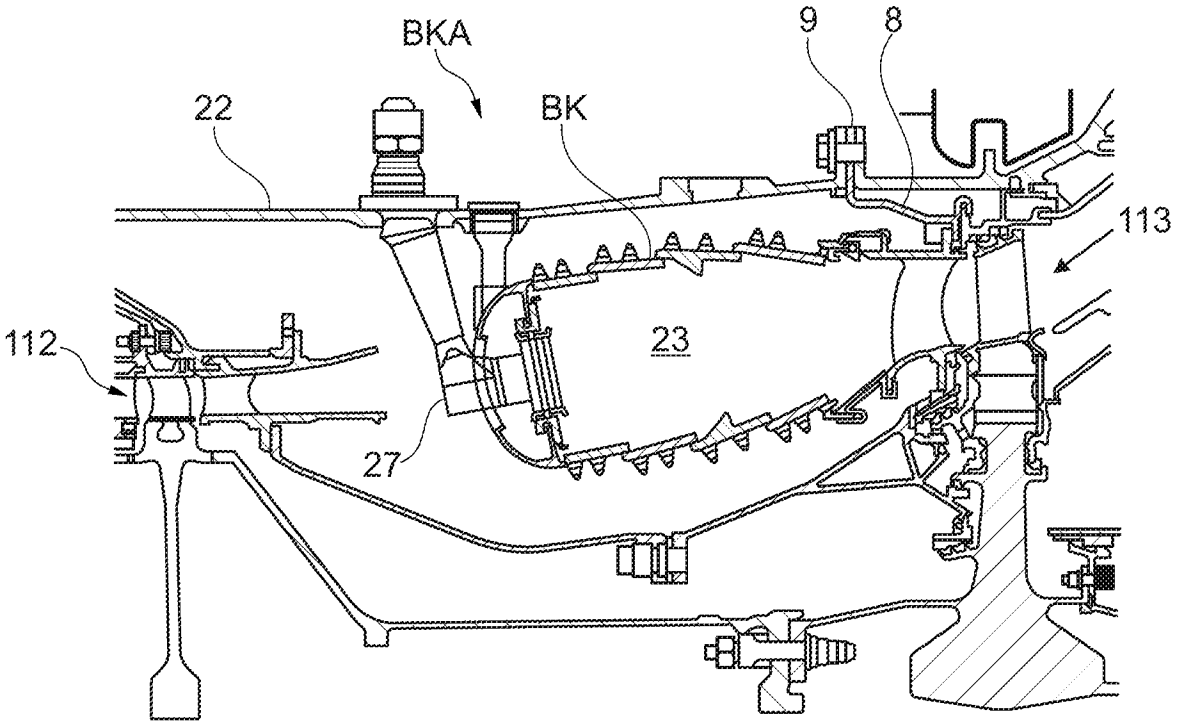
FIG. 5 shows, in extract and on an enlarged scale, the combustion chamber of the engine of FIG. 4.

FIG. 5 shows a longitudinal section through the combustion chamber portion BKA of the engine T. This shows in particular an (annular) combustion chamber BK of the engine T. A nozzle assembly is provided for the injection of fuel or an air-fuel mixture into a combustion space 23 of the combustion chamber BK. Said nozzle assembly comprises a combustion chamber ring, on which multiple fuel nozzles 17 are arranged along a circular line around the central axis M. Here, on the combustion chamber ring, there are provided the nozzle outlet openings of the respective fuel nozzles 17 which are situated within the combustion chamber BK. Here, each fuel nozzle 17 comprises a flange by means of which a fuel nozzle 17 is screwed to an outer casing 22 of the combustion chamber portion BKA.

Figure 6:
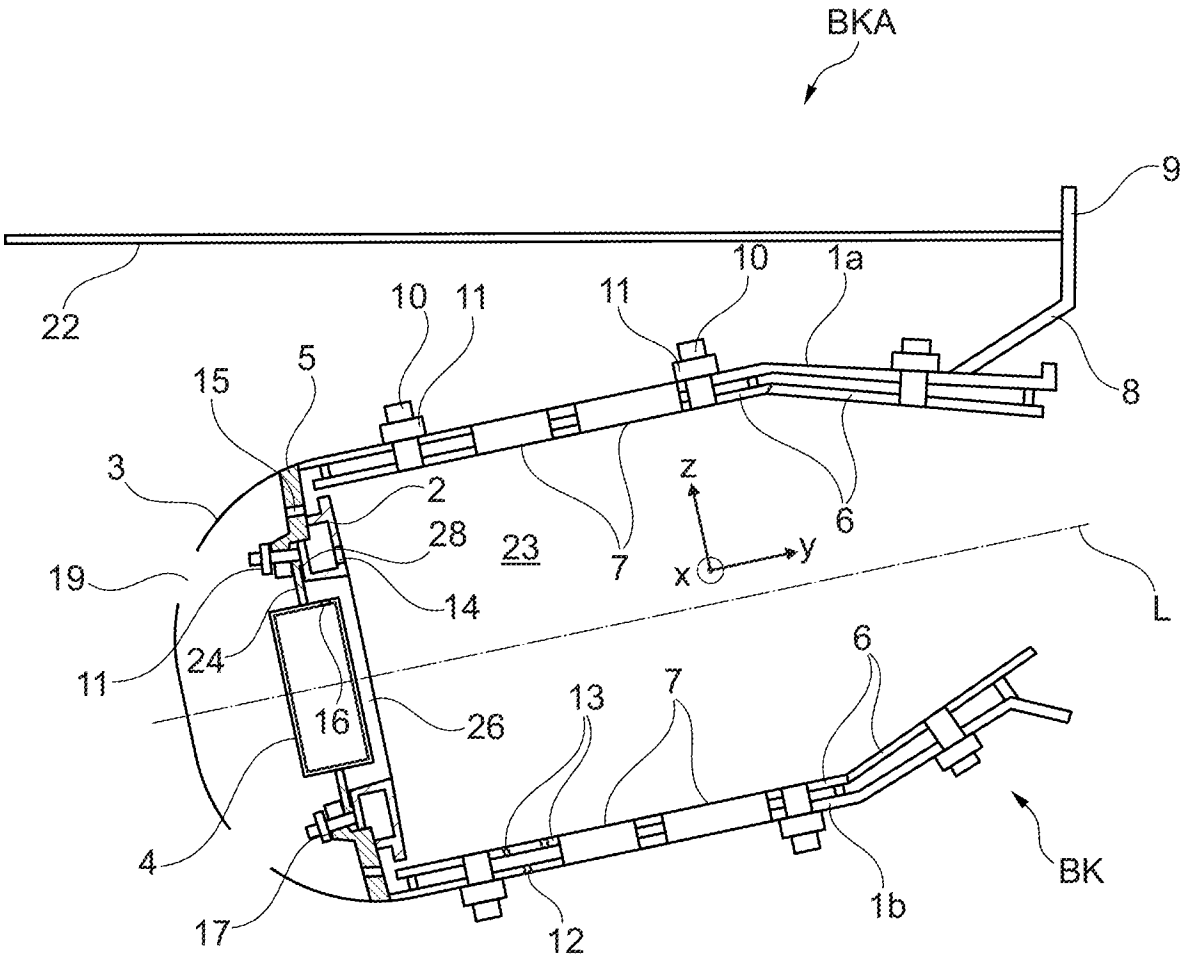
FIG. 6 shows in cross-sectional view the fundamental structure of a combustion chamber from the prior art, again on an enlarged scale in comparison with FIG. 5.

FIG. 6, in a further enlarged scale compared with FIG. 5 and in sectional view, shows a combustion chamber BK known from the prior art and in particular the configuration provided here of a burner seal 4 and a heat shield 2 in the region of a combustion chamber head 3 of the combustion chamber BK. The illustrated combustion chamber BK is in this case for example a (fully) annular combustion chamber such as is used in gas turbine engines.

The combustion chamber BK is arranged in the interior of the outer casing 22. The combustion chamber BK comprises, as combustion chamber components, a combustion chamber structure surrounding the combustion space 23, (radially) outer and (radially) inner combustion chamber walls 1*a* and 1*b*. These combustion chamber walls 1*a*, 1*b* are, depending on construction, shielded from the combustion space 23 in some cases with tile components in the form of combustion chamber tiles 6. These combustion chamber tiles 6 may for example each be connected to the inner and outer combustion chamber walls 1*a*, 1*b* by means of fixing elements in the form of bolts 10 and nuts 11. The combustion chamber walls 1*a* and 1*b* normally have cooling holes 12 and supply openings in the form of mixing air holes 7. A combustion chamber tile 6 may also be provided with effusion cooling holes 13. An outer combustion chamber wall 1*a* is connected to the outer casing 22 via an arm 8 and a flange 9.

A combustion chamber head 3, with a further combustion chamber component of the combustion chamber structure in the form of a head plate 5, is provided in a front end of the combustion chamber BK relative to a longitudinal axis L. The outer and inner combustion chamber walls 1*a* and 1*b* are connected together via this combustion chamber head 3 and the head plate 5. The head plate 5 shown here comprises cooling holes 15. Furthermore, a supply opening 26 is formed on the head plate 5 which provides access to the combustion space 23 and in which the fuel nozzle 27 is provided.

A burner seal 4 ensures the positioning of the fuel nozzle 27 in the head plate 5, and in particular in the supply opening 26 of the head plate 5. The burner seal 4, which may also be provided with cooling holes 16, is here mounted in floating fashion and, in the illustrated embodiment variant from the prior art, is positioned on the head plate 5 by means of a front positioning part in the form of a front positioning ring 24, and by means of a rear positioning part in the form of a rear positioning ring 28. Furthermore, the burner seal 4 is bolted to a heat shield 2 lying in the combustion space 23. For this, the heat shield 2 forms fixing elements in the form of bolts 17 which are guided through fixing openings on the head plate 5 and screwed on to the nuts 11 from the side of the combustion chamber head 3. Access for mounting the nuts 11 is provided via holes 19 in the combustion chamber head 3. According to the depiction in FIG. 6, the heat shield 2 may also have cooling air holes 14 and cooling ribs or studs. The bolts 17 may also be designed as separate components and need not be formed by the heat shield 2. Such bolts 17 are then for example screwed into threaded openings of the heat shield 2 from the side of the combustion chamber head 3.

In order to achieve optimal conditions with regard to cooling and emission performance, in particular reliable positioning of the combustion chamber tile 6 relative to the mixing air holes 7 in the combustion chamber wall is necessary. It must furthermore be guaranteed that the mechanical integrity of the bolts 10 provided for fixing is not endangered by the positioning of the combustion chamber tile 6 relative to the combustion chamber wall 1*a* or 1*b* during installation and during operation of the engine T. In this context, it is usually disadvantageous for the positioning of a combustion chamber tile 6 relative to the combustion chamber wall 1*a* or 1*b* to be subject to relatively great spread, which must be taken into account in the design and tolerances to be expected. If a combustion chamber tile 6 is not positioned precisely with its mixing holes relative to the mixing air holes 7 in the combustion chamber wall, irregularities can occur in the temperature distribution of the process gas. This in turn has disadvantageous effects on the cooling air consumption and the fuel-air distribution in the combustion space 23.

Figure 1A:
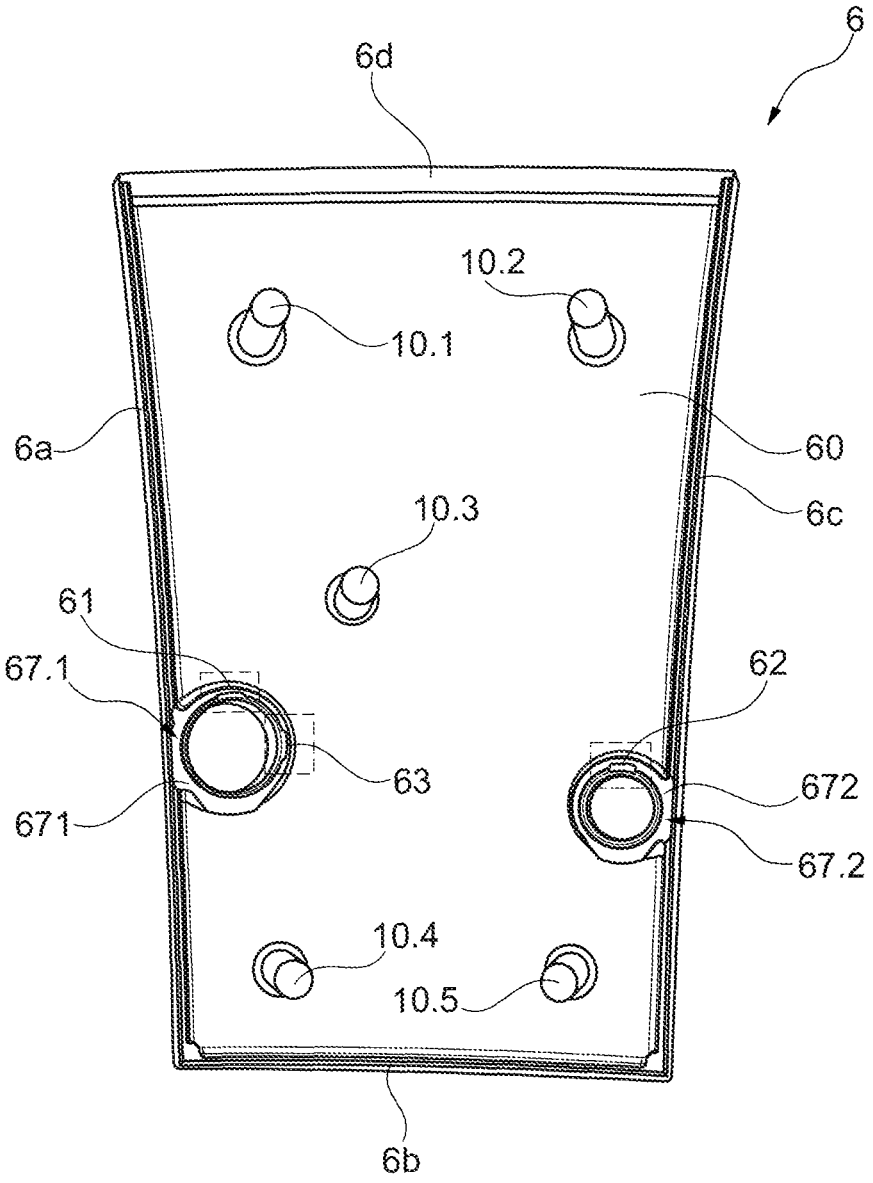
FIG. 1A shows a view onto a cold side of the tile component in the form of a combustion chamber tile according to the proposed solution, in a single view.
Figure 1B:
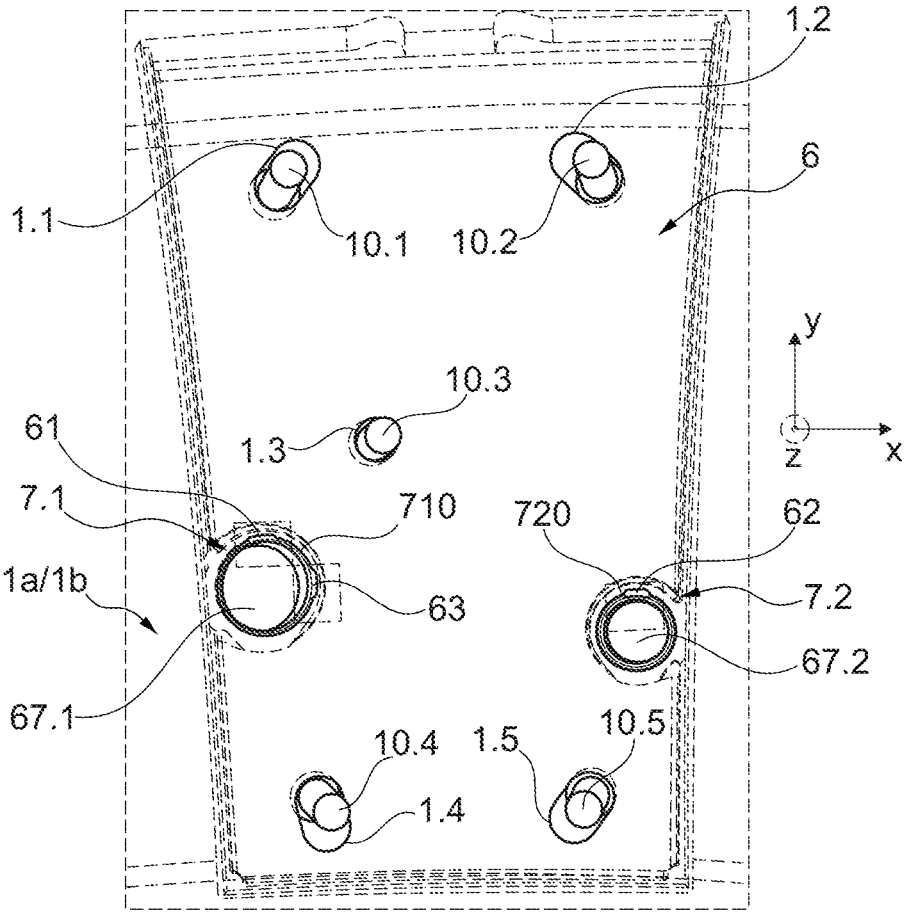
FIG. 1B shows the combustion chamber tile from FIG. 1A in the state mounted on a combustion chamber wall, with a view from the outside of the combustion chamber wall (shown transparently)

For a combustion chamber tile 6 as illustrated in FIGS. 1A and 1B, according to the proposed solution, a positioning aid with several positioning elements 61, 62 and 63 is integrated in the combustion chamber tile 6 in order to predefine a defined position relative to the combustion chamber wall 1*a* or 1*b* for the combustion chamber tile 6, and avoid the above-mentioned disadvantages.

The combustion chamber tile 6 from FIGS. 1A and 1B has a rectangular base surface and thus has four mutually connected edges 6*a* to 6*d*. These edges 6*a* to 6*d* in particular edge a cold side 60 of the combustion chamber tile 6 facing the combustion chamber wall 1*a* or 1*b* in mounted state, on which several (screw or threaded) bolts 10.1-10.5 are formed. These bolts 10.1-10.5 pass through fixing openings 1.1-1.5 on the combustion chamber wall 1*a* or 1*b* so that the combustion chamber tile 6 can be fixed to the combustion chamber wall 1*a* or 1*b* via nuts 11 screwed onto the bolts 10.1-10.5.

In the embodiment variant illustrated, several bolts 10.1, 10.2, and 10.4, 10.5 are provided close to the edge. A single bolt 10.3 is provided between two pairs of bolts 10.1/10.2 and 10.4/10.5 in a central region of the combustion chamber tile 6. This central bolt 10.3 is held concentrically in a fixing opening of the combustion chamber wall 1*a* or 1*b* with circular cross-section and also remains in position during operation of the engine T. In contrast, the bolts 10.1, 10.2, 10.4 and 10.5 arranged close to the edge, i.e. closer to the edges 6*a*, 6*b*, 6*c* and 6*d*, are received in the slot-like fixing openings 1.1, 1.2, 1.4 and 1.5 (shown exaggeratedly large in FIG. 1B) in order to allow or compensate for a thermally induced expansion of the combustion chamber tile 6 along a spatial axis y running axially.

Because of the thermally induced expansion of the combustion chamber tile 6 in operation of the engine T, and the associated tolerances to be taken into account at the fixing openings 1.1-1.5 and at the mixing air holes 7.1 and 7.2 on the combustion chamber wall 1*a* or 1*b* which are assigned to a combustion chamber tile 6 and with which mixing air holes 67.1 and 67.2 of the combustion chamber tile 6 must be brought into alignment, previously conventional combustion chamber tiles 6 cannot easily be positioned precisely relative to a combustion chamber wall 1*a* or 1*b*. In order to remedy this problem, the positioning elements 61, 62 and 63 of the positioning aid integrated in the combustion chamber tile 6 are provided at an edge 671 or 672 of a mixing air hole 67.1 or 67.2 in the tile which protrudes in the form of a collar on the cold side 60 of the combustion chamber tile 6. The positioning elements 61, 62 and 63 are each formed as locally radially protruding lugs or webs and, when the combustion chamber tile 6 is attached to the combustion chamber wall 1*a* or 1*b*, bear against a contact face 710 or 720 formed by an inner casing surface of the respective assigned mixing air hole 7.1 or 7.2 in the combustion chamber.

In the embodiment variant shown in FIGS. 1A and 1B, the mixing air holes 67.1 and 67.2 in the tile are arranged at different distances from the central bolt 10.3. At the mixing air hole 67.1 having the smallest distance from the central bolt 10.3, two positioning elements 61 and 62 are provided which protrude in two mutually perpendicular spatial directions y and x at the edge 671 of this mixing air hole 67.1. Via these positioning elements 61 and 63—relative to the fitted state—contact is possible in a direction along an axially running spatial axis y and also in a circumferential direction along a spatial axis x running perpendicularly thereto at the contact face 710 of the mixing air hole 7.1 in the combustion chamber wall. At the same time, an also radially locally protruding positioning element 62 is formed at the edge 672 of the other mixing air hole 67.2 in the tile, wherein with correct positioning of the combustion chamber tile 6 on the combustion chamber wall 1*a* or 1*b*, said positioning element also bears on the contact face 720 of the other mixing air hole 7.2 in the combustion chamber wall along the spatial axis y. Via the positioning elements 61, 62 and 63, for correct positioning of the combustion chamber tile 6 relative to the combustion chamber wall 1*a* or 1*b*, a defined contact is predefined in two spatial axes x and y, each running perpendicularly to an attachment direction +z in which the combustion chamber tile 6 is attached to an inside of the combustion chamber wall 1*a* or 1*b*.

In the embodiment variant of FIGS. 1A and 1B, thus at the outer mixing air holes 7.1 and 7.2 in the tile, a positioning aid is constructed with positioning elements 61, 62 and 63 with dedicated contact faces for bearing on casing surfaces of mixing air holes 7.1 and 7.2 in the combustion chamber wall (in each case, at two mixing air holes 67.1 and 67.2 in the tile in the axial or longitudinal direction +y, and at only one mixing air hole 67.1 in the tile also in the circumferential direction +x). Thus a defined and reproducible positioning of the combustion chamber tile 6 relative to the combustion chamber wall 1*a* or 1*b* is achieved, while minimising the component tolerances to be taken into account on design, improving the inflow of air via the mixing air holes 7.1, 7.2, and hence avoiding the above-mentioned disadvantages. Also, the tolerance chain is minimised and the installation of the combustion chamber tile 6 on the combustion chamber wall 1*a* or 1*b* is considerably simplified, since there is no need for manual orientation of the combustion chamber tile 6. On installation of the combustion chamber tile 6 on the combustion chamber wall 1*a* or 1*b*, an engineer need merely ensure that the positioning elements 61, 62 and 63 bear against the contact faces 710, 720 in order to guarantee that the combustion chamber tile 6 is positioned correctly relative to the combustion chamber wall 1*a* or 1*b*, and in particular its mixing air holes 7.1 and 7.2, before then fixing the combustion chamber tile 6 via the bolts 10.1-10.5.

The axial and circumferential positioning elements 61, 62 and 63 of the combustion chamber tile 6 in FIGS. 1A and 1B face the central bolt 10.3 in the broadest sense. The axial and circumferential positioning elements 61, 62 and 63 are thus provided on a portion of the protruding edge 671 or 672 of the mixing air holes 67.1 and 67.2 in the tile which does not face away from the central bolt 10.3. This furthermore prevents the positioning elements 61, 62 and 63 from being pressed against their contact faces 710 720 on the mixing air holes 7.1 and 7.2 in the combustion chamber wall because of the thermal expansion of the combustion chamber tile 6 in operation of the engine T (above all in the axial spatial axis y).

Figure 2:
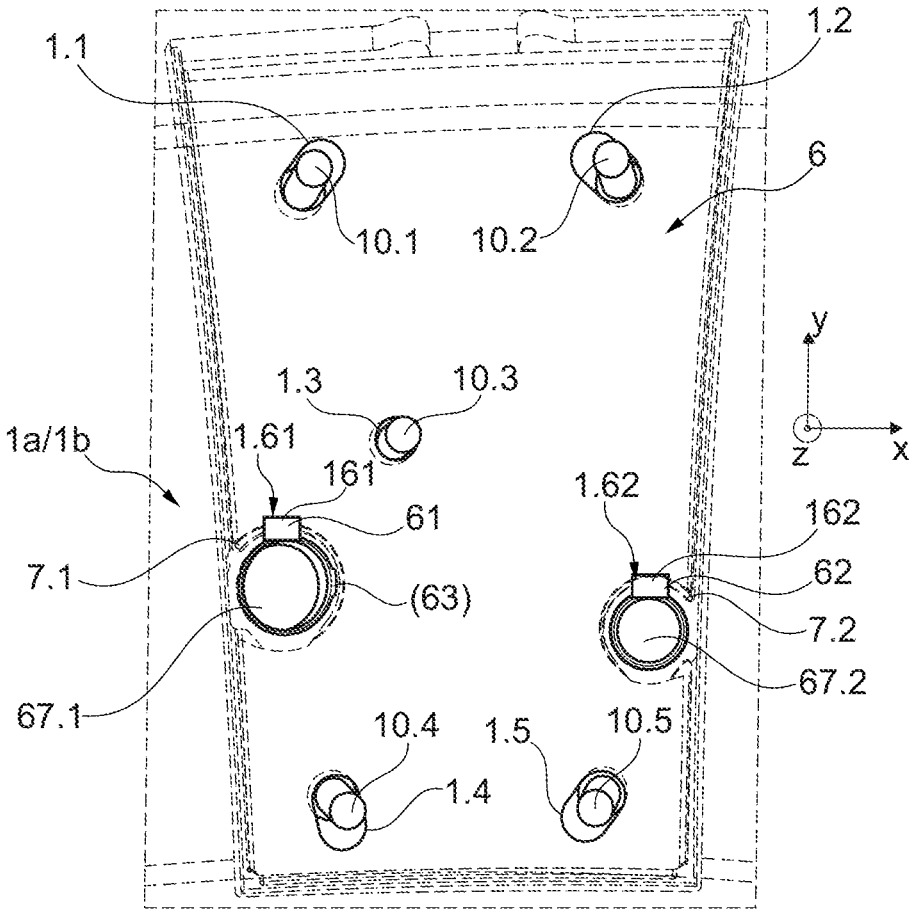
FIG. 2 shows an alternative embodiment variant of a combustion chamber tile in mounted state, in a view corresponding to FIG. 1B.

In the embodiment variant of FIG. 2, for form-fit reception of axial (i.e. protruding along the y axis) positioning elements 61 and 62 of the combustion chamber tile 6, a respective positioning recess 1.61 or 1.62 is provided on the combustion chamber wall 1*a* or 1*b* in the region of the edge of the respective assigned mixing air hole 7.1 or 7.2 in the combustion chamber wall. Here, accordingly, the edge of a mixing air hole 7.1 or 7.2 in the combustion chamber wall comprises an additional radial cutout on the inside of the combustion chamber wall 1*a* or 1*b*. A locally protruding positioning element 61 or 62 of the combustion chamber tile 6 engages in this cutout when correctly attached to the combustion chamber walls 1*a* or 1*b*, and is brought into contact in the axial direction +y and/or in the circumferential direction +x in order to predefine the defined position of the combustion chamber tile 6 relative to the combustion chamber wall 1*a* or 1*b*.

If merely a contact in the axial direction +y is provided at a contact face 161 or 162 of a positioning recess 1.61 or 1.62, then for contact in the circumferential direction +x, a positioning element 63 on the circumference may also be provided at a mixing air hole 7.1 in the tile, as shown in the embodiment variant of FIGS. 1A and 1B.

Figure 3:
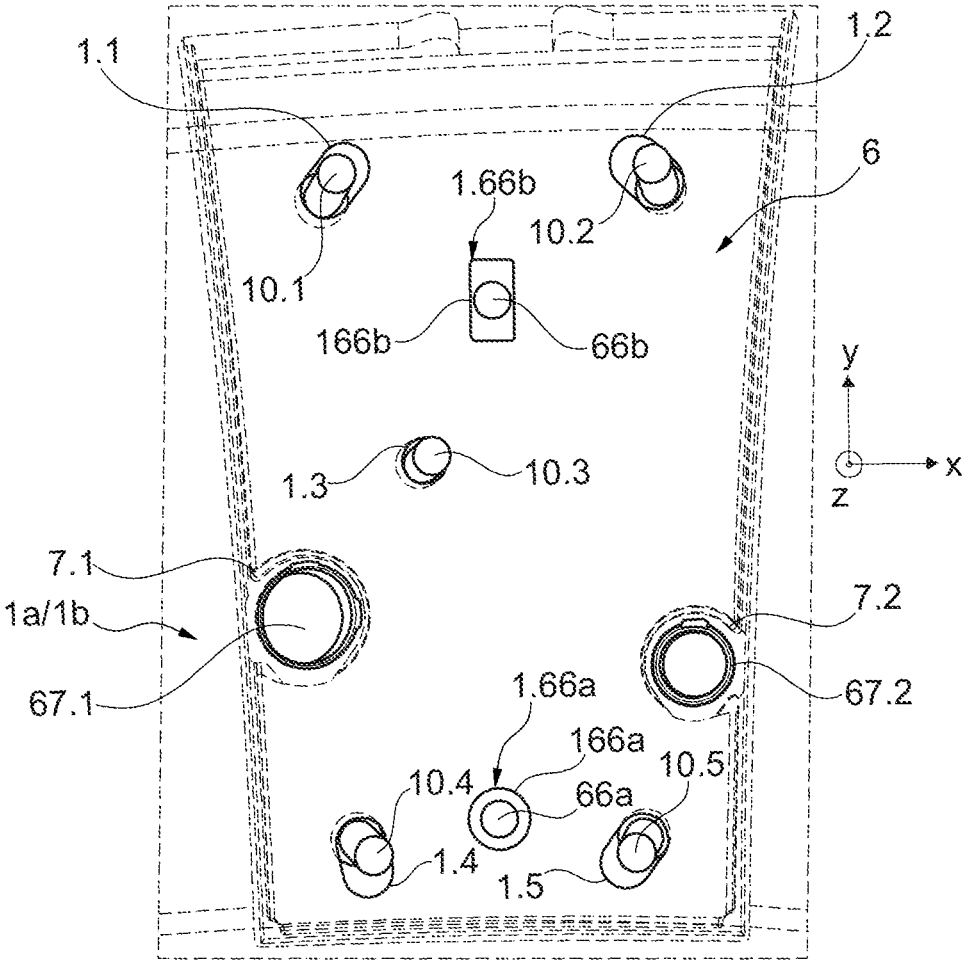
FIG. 3 shows a further embodiment variant of a mounted combustion chamber tile, in a view corresponding to FIGS. 1B and 2.

In the embodiment variant of FIG. 3, no positioning elements 61, 62 or 63 are provided at the edges 671 and 672 of the mixing air holes 67.1 and 67.2 in the tile. Rather, the combustion chamber tile 6 here comprises on its cold side 60 two positioning elements which protrude separately in the direction of the combustion chamber wall 1*a* or 1*b*, in the form of first and second positioning pins 66*a* and 66*b*. These positioning pins 66*a* and 66*b* engage in positioning openings 1.66*a* and 1.66*b* formed on the inside of the combustion chamber wall 1*a* or 1*b* (not continuous openings), which form contact faces 166*a* and 166*b* for contact of the positioning pins 66*a* and 66*b*.

A first positioning pin 66*a*, provided as an example close to the edge and centrally between two bolts 10.4 and 10.5, here engages concentrically in a positioning opening 1.66*a* of the combustion chamber wall 1*a* or 1*b* with circular cross-section. The second positioning pin 66*b*, spaced apart therefrom and arranged between bolts 10.1, 10.2 close to the edge and the central bolt 10.3, in contrast engages in a positioning opening 1.66*b* which has a slot-like cross-section. The second positioning pin 66*b* is here brought in the circumferential direction +x (or −x) into contact with one of two mutually opposing, primary contact face portions. The second positioning pin 66*b* is however spaced from the secondary contact face portions which connect together the two primary contact face portions and define the ends of the slot-like cross-section. With a positioning aid with such separate positioning elements 66*a*, 66*b* integrated on the cold side 60 of the combustion chamber tile 6, a positionally precise attachment of the combustion chamber tile 6 on the combustion chamber wall 1*a* or 1*b* is also achieved, and at the same time thermal expansion of the combustion chamber tile 6 in operation of the engine T can be taken into account.

A combustion chamber tile 6 of the above-mentioned embodiment variants may in principle be produced by an additive production process or a casting process. It is provided for example that a combustion chamber tile 6 is first produced with the bolts 10.1-10.5 moulded thereon, and with the mixing air holes 67.1 and 67.2 in the tile. Then in a separate work process, for example the web-like positioning elements 61, 62 and 63 are moulded, which protrude at the edges 671 and 672 in spatial directions running perpendicularly to each other. In this way for example, a combustion chamber tile 6 may be produced conventionally for a combustion chamber portion BKA via an existing casting mould, and then the positioning elements 61, 62 and 63 of the positioning aid to be integrated in the combustion chamber tile 6 are moulded on.

LIST OF REFERENCE SIGNS

1.1-1.5 Bolt hole (fixing opening)
1.61, 1.62 Positioning recess
1.66*a*, 1.66*b* Positioning opening
10 Bolt (fixing element)
11 Nut
111 Low-pressure compressor
112 High-pressure compressor
113 High-pressure turbine
114 Medium-pressure turbine
115 Low-pressure turbine
12 Cooling hole
13 Effusion cooling hole
14 Cooling air hole
15 Cooling hole
16 Cooling hole
161, 162 Contact face
166*a*, 166*b* Contact face
17 Bolt (fixing element)
19 Hole
1*a*, 1*b* (Outer/inner) combustion chamber wall
2 Heat shield (tile component)
22 Outer casing
23 Combustion space
24 Front position ring
26 Passage hole (passage opening)
27 Fuel nozzle
28 Rear position ring
3 Combustion chamber head
4 Burner seal
5 Head plate (combustion chamber component)
6 Combustion chamber tile (tile component)
60 Cold side
61, 62 (Axial) positioning element
63 (Circumferential) positioning element
66*a* First positioning pin (positioning element)
66*b* Second positioning pin (positioning element)
67.1, 67.2 Mixing air hole in tile (passage opening)
671, 672 Edge

6*a*-6*d* Edge
7 Mixing air hole (supply opening)
7.1, 7.2 Mixing air hole in combustion chamber wall (supply opening)
710, 720 Contact face
8 Arm
9 Flange
A Outlet
B Bypass channel
BK Combustion chamber
BKA Combustion chamber portion
C Outlet cone
E Inlet/Intake
F Fan
F1, F2 Fluid flow
FC Fan casing
L Longitudinal axis
M Central axis/axis of rotation
S Rotor shaft
T (Turbofan) engine
TT Turbine
V Compressor

The invention claimed is:

1. A combustion chamber assembly for an engine, comprising:

a combustor dome and a combustion chamber wall which is annular and surrounds a combustion space, and a tile component fixed on the combustion chamber wall and having a hot side facing the combustion space and a cold side facing away from the combustion space and towards the combustion chamber wall, wherein the tile component includes at least one air passage opening having a first axis and a first edge protruding in a direction toward the combustion chamber wall, and on the cold side at least one fixing element for fixing the tile component to the combustion chamber wall, wherein the combustion chamber wall includes at least one fixing opening for the at least one fixing element and at least one air supply opening with which the at least one air passage opening of the tile component is aligned, the at least one air supply opening including at least one contact face, at least two positioning elements positioned on the cold side of the tile component, wherein a defined position relative to the combustion chamber wall is predefined for the tile component via a contact of the at least two positioning elements on the at least one contact face of the combustion chamber wall in two spatial axes;

wherein the first edge protruding in the direction toward the combustion chamber wall extends inside of the at least one air supply opening, the first edge including a first positioning element of the at least two positioning elements that protrudes radially, with respect to the first axis and only partially around a circumference of the first edge, from the first edge toward the at least one contact face to engage the at least one contact face to obtain the defined position of the tile component with respect to the combustion chamber wall.

2. The combustion chamber assembly according to claim 1, wherein the two spatial axes run perpendicularly to an attachment direction in which the tile component is mounted on the combustion chamber wall.

3. The combustion chamber assembly according to claim 2, wherein a first spatial axis of the two spatial axes extends tangential to a circumferential direction of the combustion chamber assembly, and a second spatial axis of the two spatial axes extends in a flow direction in which fluid flows in the direction of an outlet from the combustion space during operation of the engine.

4. The combustion chamber assembly according to claim 1, wherein the at least one fixing element includes a plurality of fixing elements and the at least one fixing opening includes a plurality of fixing openings to respectively receive the plurality of fixing elements.

5. The combustion chamber assembly according to claim 1, wherein the first edge includes a second positioning element of the at least two positioning elements that protrudes radially, with respect to the first axis and only partially around a circumference of the first edge, from the first edge toward the at least one contact face to engage the at least one contact face to obtain the defined position of the tile component with respect to the combustion chamber wall, the second positioning element being circumferentially spaced around the first edge from the first positioning element.

6. The combustion chamber assembly according to claim 1, wherein the first positioning element is positioned to protrude locally in a first spatial axis of the two spatial axes, and the second positioning element is positioned to protrude locally in a second spatial axis of the two spatial axes.

7. The combustion chamber assembly according to claim 1, wherein the at least one air passage opening includes two air passage openings, and each of the two air passage openings includes at least one of the at least two positioning elements that engages the at least one contact face.

8. The combustion chamber assembly according to claim 1, wherein the at least one fixing element includes a plurality of fixing elements and the at least one fixing opening includes a plurality of fixing openings to respectively receive the plurality of fixing elements, with a first fixing element of the plurality of fixing elements being positioned in a central region of the tile component, and the first positioning element protruding toward the first fixing element.

9. The combustion chamber assembly according to claim 8, wherein the at least one air passage opening includes two air passage openings which have different distances from the first fixing element, and the first positioning element and a second positioning element of the at least two positioning elements are both provided on the first edge, the first edge being an edge of one of the two air passage openings that is closest to the first fixing element.

10. The combustion chamber assembly according to claim 1, wherein the at least one contact face includes at least one positioning recess for receiving the first positioning elements.

11. The combustion chamber assembly according to claim 10, wherein the at least one positioning recess is positioned at an edge of the at least one air supply opening.

12. The combustion chamber assembly according to claim 1, and further comprising at least one positioning opening positioned in the combustion chamber wall spaced apart from the at least one air passage opening and the at least one fixing element, wherein at least one of the at least two positioning elements is positioned in the at least one positioning opening.

13. The combustion chamber assembly according to claim 12, wherein the at least one positioning opening includes two positioning openings respectively receiving one of the at least two positioning elements.

14. The combustion chamber assembly according to claim 13, wherein a first positioning opening of the two positioning openings has a circular cross-section, and a second positioning opening of the two positioning openings has a rectangular cross-section.

15. An engine with the combustion chamber assembly according to claim 1.

16. A method for producing a combustion chamber assembly for an engine comprising at least the following steps:

providing a combustion chamber structure including a combustor dome and a combustion chamber wall which is annular and surrounds a combustion space, and providing a tile component to be fixed on the combustion chamber wall and having a hot side which, in a mounted state, faces the combustion space, and a cold side which, in a mounted state, faces away from the combustion space and towards the combustion chamber wall, providing that the tile component comprises at least one air passage opening having a first axis and a first edge protruding in a direction toward the combustion chamber wall, and on the cold side at least one fixing element for fixing the tile component to the combustion chamber wall, providing that the combustion chamber wall has at least one fixing opening for the at least one fixing element and at least one air supply opening with which the at least one air passage opening of the tile component is aligned, the at least one air supply opening including at least one contact face when the tile component is mounted on the combustion chamber wall, providing at least two positioning elements on the cold side of the tile component, wherein a defined position relative to the combustion chamber wall is predefined for the tile component, when mounted on the combustion chamber wall, via a contact of the at least two positioning elements on the at least one contact face of the combustion chamber wall in two spatial axes, before the tile component is fixed to the combustion chamber wall, providing that the first edge protruding in the direction toward the combustion chamber wall extends inside of the at least one air supply opening, the first edge including a first positioning element of the at least two positioning elements that protrudes radially, with respect to the first axis and only partially around a circumference of the first edge, from the first edge toward the at least one contact face to engage the at least one contact face to obtain the defined position of the tile component with respect to the combustion chamber wall.

* * * * *